US006143095A

United States Patent [19]

Kim et al.

[11] Patent Number: 6,143,095

[45] Date of Patent: Nov. 7, 2000

[54] METHOD FOR SURFACE-ALLOYING ON METAL OR ALLOY SUBSTRATES, OR FOR SURFACE-REPAIRING THE DAMAGED (OR FAILED) METAL OR ALLOY SUBSTRATES USING A LASER BEAM

[75] Inventors: Joung Soo Kim; Jeong Hun Suh; Il Hiun Kuk, all of Taejon-si, Rep. of Korea

[73] Assignees: Korea Atomic Energy Research Institute, Taejon-si; Korea Electric Power Corporation, Seoul

[21] Appl. No.: 09/121,772

[22] Filed: Jul. 23, 1998

[30] Foreign Application Priority Data

Jul. 29, 1997 [KR] Rep. of Korea ..... 97-35840

[51] Int. Cl.[7] ..... C23C 4/12

[52] U.S. Cl. ..... 148/224; 148/512; 148/525

[58] Field of Search ..... 148/512, 525, 148/565, 224

[56] References Cited

U.S. PATENT DOCUMENTS 4,015,100 3/1977 Gnanamuthu et al. ..... 148/512
4,299,860 11/1981 Schaefer et al. ..... 148/525
4,495,255 1/1985 Draper et al. ..... 148/512
4,750,947 6/1988 Yoshiwara et al. ..... 148/512
5,271,840 12/1993 Shimura et al. ..... 148/565
5,554,415 9/1996 Turchan et al. ..... 148/512

*Primary Examiner*—George Wyszomierski
*Attorney, Agent, or Firm*—Bachman & LaPointe, P.C.

[57] ABSTRACT

The present invention is related to the method for surface-alloying comprising the steps of: (a) plating alloying ingredients on the surface of metal or alloy substrate to form plated layer, and (b) melting this surface using a laser beam to form an alloyed layer of which composition is different from that of base material. And, the method of this invention may further include surface-reforming method of metal or alloy substrate. And the method of this invention may further include surface-repairing method of damaged metal or alloy substrate. Using the method of this invention, an alloyed layer, which has improved resistance to grain boundary related material degradation phenomena, e.g. stress corrosion cracking, abrasion, fatigue, erosion, and so on, can be formed.

8 Claims, 6 Drawing Sheets

METHOD FOR SURFACE-ALLOYING ON METAL OR ALLOY SUBSTRATES, OR FOR SURFACE-REPAIRING THE DAMAGED (OR FAILED) METAL OR ALLOY SUBSTRATES USING A LASER BEAM

BACKGROUND OF THE INVENTION

The present invention relates to a method for surface-alloying on metal or alloy substrates, or for surface-repairing the damaged(or failed) metal or alloy substrates using laser beam. Particularly, the present invention relates to the method for surface-alloying or surface-repairing comprising the steps of: (a) plating an alloying ingredient on the surface of metal or alloy substrate, and (b) melting this plated surface using a laser beam to form an alloyed layer, the composition of which is different from the base(substrate) material. From the method of this invention, the alloyed layer, which has higher resistance to corrosion, stress corrosion cracking, fatigue, erosion and so on than that of the surface of the base material, can be formed on the surface of the substrate.

Several methods for surface-alloying have been used; thermal treatment, wet (elestroless or electro-) plating, dry plating, metalizing, thermal spraying, plasma cladding and surface alloying method using an electron beam under vacuum.

In the surface-alloying method by thermal treatment, (a) specific metal or nonmetal element(s) is(are) forced to be injected into the surface of substrate by heating the substrate and the metal or nonmetal element(s) at the same time and thus increasing the activation energy of this(these) element (s). This method includes gas or ion(plasma) carburization, nitriding (gas nitriding, nitriding in salt bath, ion nitriding), boriding, ion implantation and so on. However, these methods have limitations in some points: restriction in alloying ingredients to be implanted (e.g. restricted to nonmetal elements), restriction of the obtainable thickness of alloyed layers (e.g. several "nm" in case of ion implantation), and shape changes of the treated parts due to treatment of high temperature.

In case of wet (electroless or electron-) plating, it is difficult to obtain varieties of alloyed layers due to the restriction in alloying ingredients which can be added to the surface of a metal or alloy substrate, and in addition, the plated layer can be delaminated from the surface of the substrate.

Various alloyed layers can be formed by dry plating methods compared with the wet plating ones, but there also are some restrictions in the dry plating methods; the plating processes are rather complicated and difficult than those in other methods because of being carried out in vacuum, and it is not easy to form a thick coated layer with these methods. Furthermore, the separation of the coated layer can also occur.

Metalizing is a method that alloying processes are performed by penetrating alloying elements into base material in a salt bath at high temperature. This method is controlled by diffusion processes of the alloying ingredients into the substrate under the thermal equilibrium state conditions, which means that there may be restrictions in the kinds of alloying ingredients, and the compositions and the thickness of the alloyed layer. On the other hand, dimensional changes may be caused due to the processes at high temperature.

Using thermal spraying, various alloyed coats can be obtained. The limitations in this method, however, are pores formed in the coated layers (less than 10% in case of plasma spray, less than 5% in case of high velocity oxy-fuel spray) and oxidation of the alloying ingredients during spraying in air. In order to overcome these limitations in thermal spray techniques, spray processes under low pressure or in vacuum have been developed. But even with these new methods, it is nearly impossible to obtain perfect pore free coated layers. Moreover delamination on the coated layer formed by the thermal spray may occur in use since the coated layer is mechanically bound with the base material.

Plasma cladding method is now under development, which is a much more flexible process to obtain a desired alloyed layer and its thickness in air. But heat affected zone with this method is larger than that with the process with a laser beam is, since the energy density of the plasma is lower than that of a laser beam. A limitation of this preocess is difficult to form a uniform surface-alloyed layer of a part having geometrically complicated shape.

A surface alloying method using an electron beam has restrictions in the size and shape of the treated part because the whole process should be carried out under vacuum and electron gun cannot move freely.

The present inventors have successfully completed surface alloying on Ni-base alloy with a laser beam, the method of which is superior to the former methods described above.

SUMMARY OF THE INVENTION

It is an object of the invention to provide a method for surface-alloying and/or reforming on metal or alloy substrate, particularly on Ni-base alloy, which can form an alloyed layer with high resistance to corrosion, stress corrosion cracking, fatigue, abrasion, erosion, etc.

Another object is to provide a method for surface-repairing a damaged metal or alloy substrate, particularly on Ni-base alloy, by forming an alloyed layer having high resistance to corrosion, stress corrosion cracking, fatigue, abrasion, erosion, etc.

DETAILED DESCRIPTION OF THE INVENTION

Figure 1:
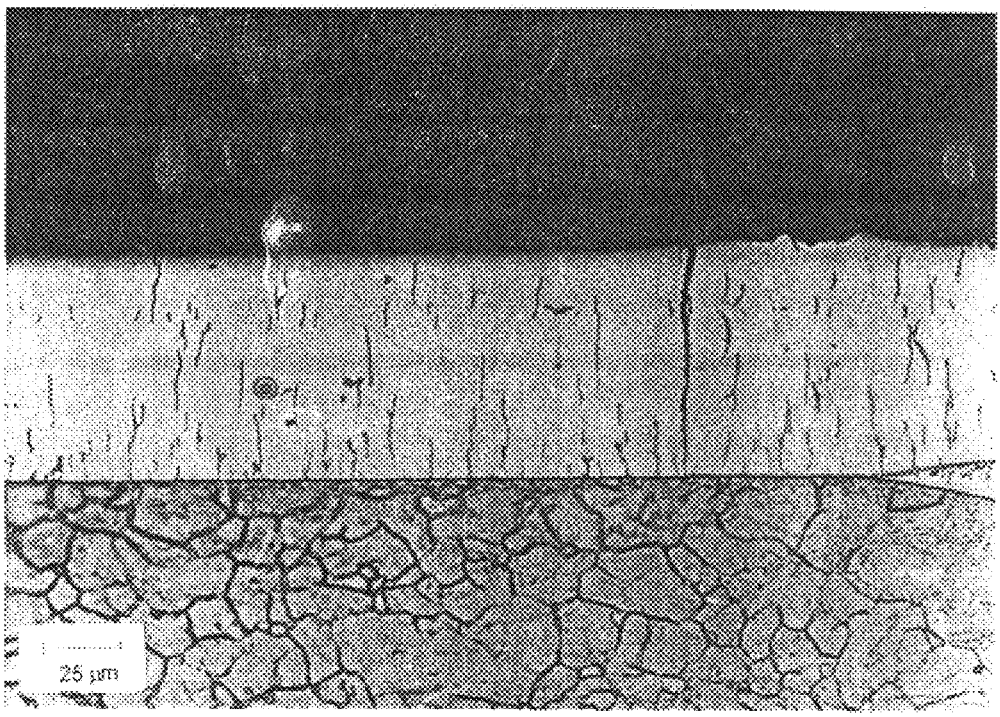
FIG. 1 shows microstructure of Cr-plated layer on the surface of Alloy 600 material.
Figure 2:
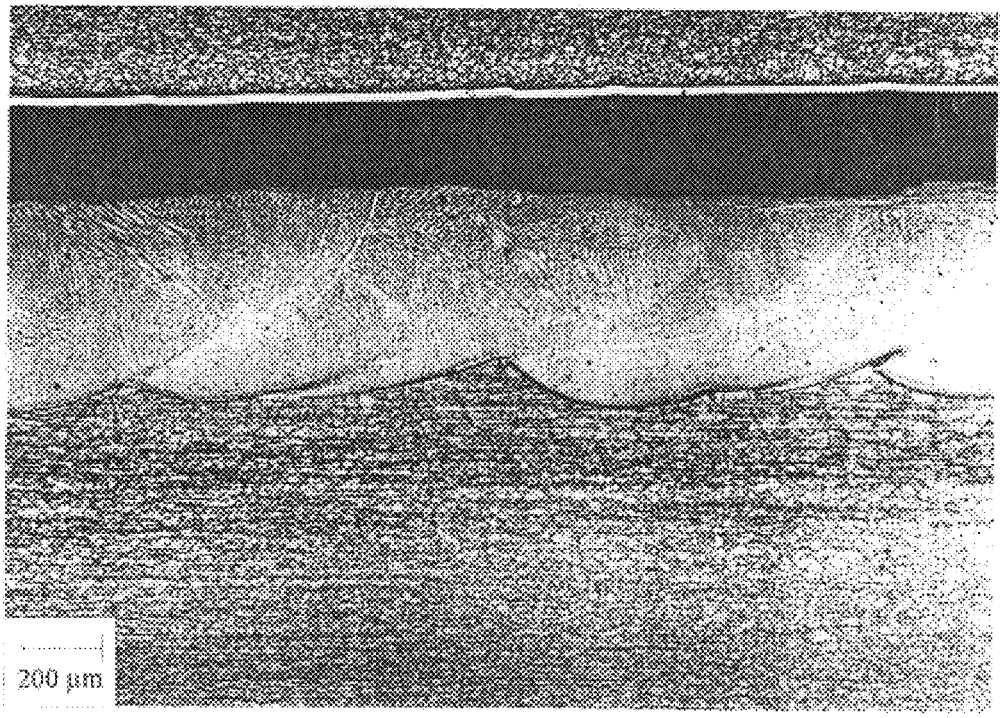
FIG. 2 shows microstructure of the Cr-plated surface (as shown in FIG. 1) of Alloy 600 melted by a $CO_2$ laser beam at a laser power of 2 kW.

In order to attain the object of this invention, the surface-alloying method of this invention comprises the steps of:

(a) plating alloying ingredients on the surface of metal or alloy substrate, particularly on Ni-base alloy by electroless, electro-plating or the like to form a plated layer on the substrate; and (b) melting this surface by irradiating a laser beam to form an alloyed layer.

The method of this invention may further include the surface-reforming and surface-repairing methods.

A laser beam can melt any material very rapidly due to its high energy density. This process with a laser beam can also easily control the compositions and the depth of an alloyed layer on the surface of substrate, depending on the application of the resultant alloyed surface. In addition, the laser beam has many advantages in melting materials compared to other heat sources: Formation of narrow heat affected zone due to its high energy density; Fine microstructure of the resultant alloyed surface due to the rapid cooling(quenching) of the melt; Higher solid solubility than that expected from the phase diagram obtained from the thermal equilibrium conditions; Homogeneous microstructure of the alloyed layer due to the extensive mixing of the molten pool resulted from high temperature gradient established during laser melting; Treatment possible in air without oxidation of the treated region; and No delamination of the alloyed layer from the base material.

In the first step of this invention, a coated layer on the surface of metal or alloy substrate, particularly of Ni-base alloy is formed with any plating method including electroless or electroplating. The thickness of the coated(plated) layer can be controlled according to the desired thickness and/or compositions of a resultant alloyed layer.

In the second step of this invention, the coated (plated) surface is melted using a laser beam. This step can be carried out in air or vacuum. The thickness and compositions of the alloyed layer can be controlled according to the thickness of coating layer formed in the first step and the conditions of laser treatment (e.g. dimension of output, scan speed of laser beam).

In order to attain desired alloy compositions, it is necessary to control melted depth, which can be controlled by the conditions of laser melting parameters such as the output power (which also depends on the beam size and the position of a focal point of the beam) and scan speed of a laser beam. The optimum conditions for the laser melting parameters should be determined by experiments.

In order to form a uniformly alloyed layer on the whole surface of a substrate, each beam scan is overlapped by about half of the beam size. But the extent of the beam overlapping can be varied optionally to obtain the desired fine microstructure and compositions of the surface-alloyed layer.

In the melting step using a laser beam to form a surface alloyed layer, it is preferred to flow (an) inert gas(es) such as Ar, $N_2$, or $H_2$ to the melted zone in order to prevent the zone from oxidation. An optimum flow rate of the gas(es) can be controlled depending on the size and power of the beam (thus on the size of a molten pool), and a beam scan rate, and should be determined by experiments. Melted depth has to be shallow for the composition of the added alloying element in the alloyed layer to be high when the thickness of a plated layer is constant. On the other hand, a plated layer should be thick for the composition of the added alloying element in the alloyed layer to be high in case that a melted depth keeps constant. The compositions and thickness of a alloyed surface layer can be controlled depending on the desired application of the surface layer.

In case that alloying ingredients are non-metal elements such as nitrogen, oxygen, carbon and the like, surface alloying can be done by flowing the gas(es) into a molten pool during laser surface melting.

This surface alloying method on metal or alloy substrate, particularly on Ni-base alloy, of the present invention can be applied to steam generator tubing in nuclear power plants.

Alloy 600 (Inconel 600) which is being used as steam generator tubing in nuclear power plants is degraded by localized corrosion such as pitting, stress corrosion cracking, etc., when it has been used under the operating conditions of nuclear power plants. The composition of Alloy 600 is as follows:

Nickel 72.0 wt. % min.

Chromium 14.0–17.0 wt. %

Iron 6.0–10.0 wt. %

Manganese 1.0 wt. % max.

Carbon 0.15 wt. % max.

Copper 0.5 wt. % max.

Silicon 0.5 wt. % max.

Sulfur 0.015 wt. % max. In this case, the damaged tubes are plugged or sleeved for further operation of the nuclear power plants, resulting in reduction of the thermal efficiency of power plants. When the tubes are failed by the localized corrosion during operation of nuclear power plants, serious safety problem can occur by the leakage of a radioactively contaminated primary cooling water into the secondary system, resulting in radioactively contaminating the secondary system. This in turn causes the operation efficiency of the power plant to be reduced and also great cost for keeping the steam generator operatable.

Lifetime of the tubes of steam generator can be expanded by increasing Cr content on the surface of Alloy 600, where the localized corrosion most frequently occurs during operation, with this laser surface alloying method upto 30 wt. % like Alloy 690 (Inconel 690), which has been known to have high resistance to localized corrosion.

In addition, stress corrosion cracking frequently occurs at the welded zone of penetration in the nuclear reactor cover, of instrumentation sleeves on a nuclear reactor or of pressurizer nozzles in which Alloy 600 material is being used. This kind of degradation can be mitigated or prevented by applying the surface-alloying method to the above-mentioned zones.

The invented method for laser-surface-alloying can be applied to the tubes during manufacturing them at factories or during operation after the construction of nuclear power plants. Also, this method can be applied to industrial machine parts very effectively without changing the properties of base materials themselves but with changing only their surface properties in order to improve resistance to corrosion, abrasion, fatigue life, erosion and so on.

Hereinafter, the invention has been illustrated for reference by giving a specific example. The following example is only for showing the application of the present invention, but the claims of the present invention are not limited within this example.

EXAMPLE (1) Preparation of Material and Process for Surface-Plating

Commercial Alloy 600 (Inconel 600) plate of 1.6 mm in thickness was used. The compositions of this material is shown in Table 1.

TABLE 1

| element | Ni | Cr | Fe | C | Si | Al | Ti |
|---|---|---|---|---|---|---|---|
| wt. % | Bal. | 15.7 | 7.5 | 0.035 | 0.15 | 0.12 | 0.17 |

The samples which were cut in a proper size(2×2 $mm^2$) from the plate were polished up to a sand paper, No.1200, and then washed with methanol in a ultrasonic bath followed by washing in flowing water. Cr was plated on the specimens in 250 g $CrO_3$+2.0 g $H_2SO_4$+5.0 g $NaSiF_6$+6.0 g 1,2,3-Naphthalene-tri-sulfonic acid+0.2 g 1,4-Butanediol solution at 60° C. for 2 hours by flowing a current density of 80 A/$dm^2$. Under these conditions, Cr layer of 50–70 $\mu$m in thickness was obtained as shown in FIG. 1. The efficiency for the plating was about 26.4%. The plated specimens were taken out of the solution, washed with flowing water and dried in air.

(2) Melting Treatment of the Plated Surface and Composition Analysis of an Alloyed Layer The Cr-plated surface of the specimen was melted using a $CO_2$ CW laser heat treatment system (the maximum output power of which is 3.5 kW) at a beam power of 2 kW and a scan rate of 100 cm/min. The specimen to be treated was laid at the focal point of the laser beam. Under these conditions, melted(alloyed) depth was measured to be 200–250 $\mu$m to render the surface composition of Alloy 600 into the composition of Alloy 690 (concentration of Cr is about 30 wt. %). In order to attain the above mentioned Cr composition of the alloyed layer from Cr plated layer, the optimum condition has to be determined by experiments since the composition is dependent on the size of a laser beam and the position of the specimen from a focal point of the beam. In the surface melting step, each beam scan was overlapped by about half of the beam size in order to form a uniform alloyed layer on the whole surface of the alloy substrate. During irradiating the laser beam, Argon gas was blown to the molten pool at a flow rate of 10 L/min. to prevent the melted zone from oxidation.

To measure the depth and the distribution of the major alloying elements of the alloyed layer, the specimens were cut in the direction of thickness, mounted with epoxy resin and polished using 0.05 $\mu$m of alumina powder. The polished surface was washed with acetone and methyl alcohol, and then etched by applying a voltage of 1.5–2.0V for 20–30 seconds in a Nital solution.

Figure 3A:
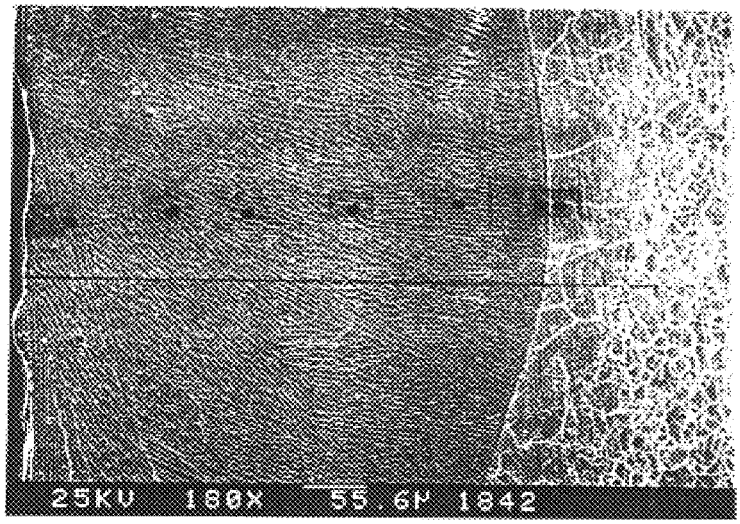
FIG. 3*a* shows microstructure of the alloyed surface (magnified view of FIG. 2).
Figure 3B:
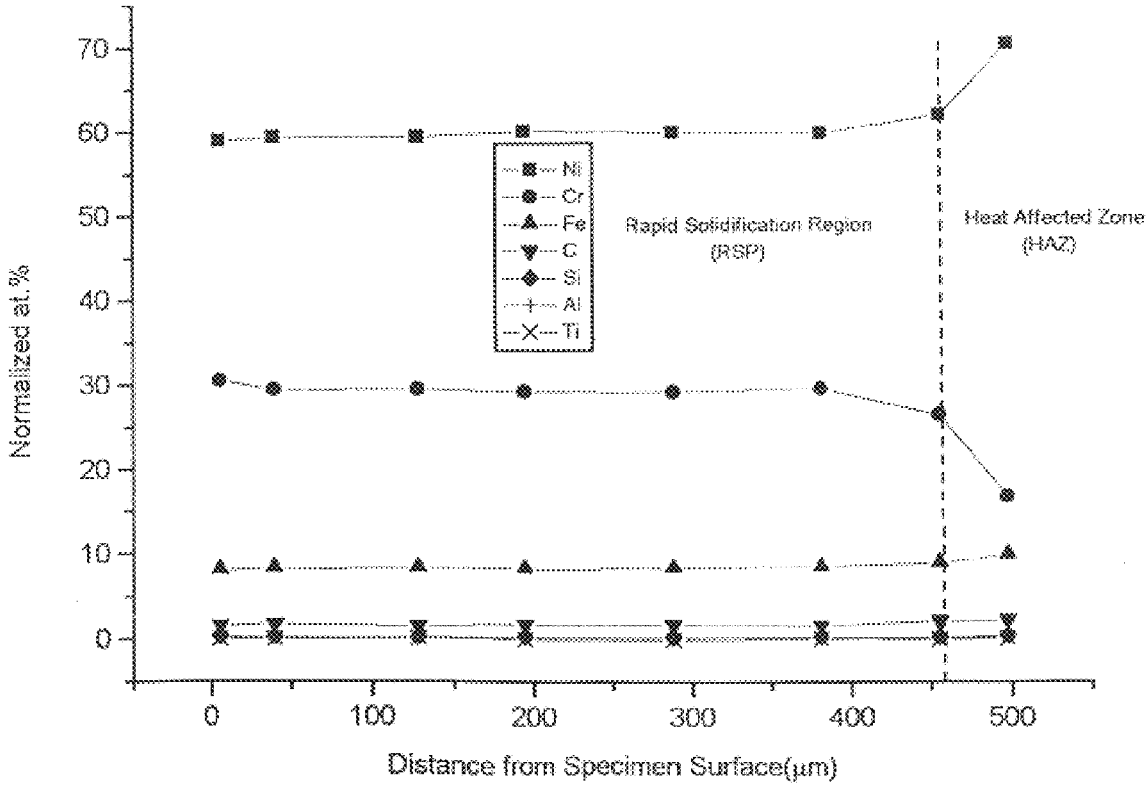
FIG. 3*b* shows the variation of the major alloying elements of the alloyed layer formed on the surface of Alloy 600.
Figure 7:
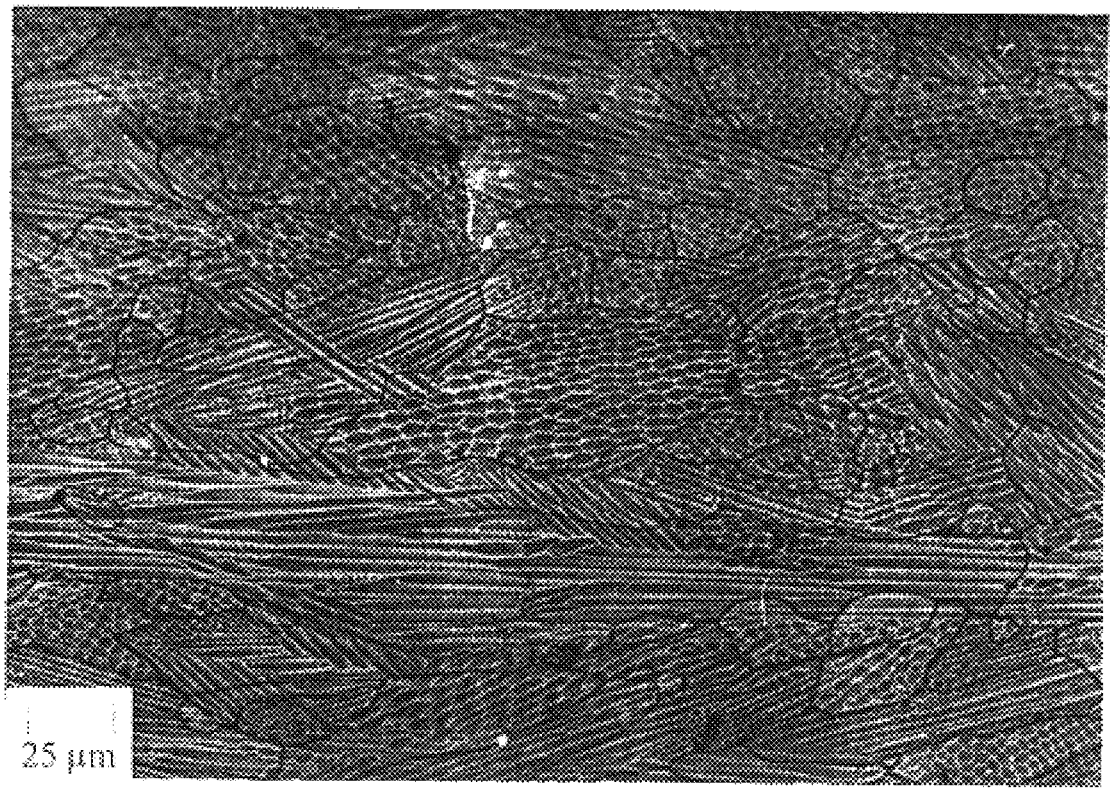
FIG. 7 is an SEM micrograph of the alloyed surface of Alloy 600 after the modified Huey test.

The observation of surface morphology and the analysis of compositions of the alloyed specimens were carried out using optical microscopy and scanning electron microscopy equipped with wavelength dispersive X-ray spectroscopy (WDX). The microstructure of the alloyed layer was cellular structure and was very homogeneous (FIG. 3*a* and FIG. 7). Also, as shown in FIG. 3*b*, the compositions of the major alloying elements in the alloyed layer were distributed homogeneously, and the compositions of Ni, Cr, Fe were measured to be 60 wt. %, 30 wt. % and 7 wt. %, respectively, which were turned out to be as expected.

(3) Test for Corrosion Property

Three different corrosion tests with the surface alloyed specimens were carried out such as anodic polarization measurement to see their anodic behaviour, and the double loop electrochemical potentiodynamic reactivation(EPR) test and the modified Huey to investigate the grain boundary corrosion resistance.

Anode polarization and EPR curves were measured in 0.01M $H_2SO_4$+0.0001M KSCN solution at 25° C. with a scan rate of 0.5 m/sec. During the measurement, high purity $N_2$ gas flowed through the solution to minimize the effect of oxygen in the solution. A saturated calomel electrode (SCE) was used as a standard one.

The modified Huey test was performed by immersing the specimens in $HNO_3$ solution boiling at 110–120° C. for 48 hours. Before immersed in the test solution, the specimens were polished to a sand paper, No.600, washed and dried followed by measuring the weight of the specimens. After the immersion tests, the specimens were washed and dried to measure their weight. From the difference in the weights of the specimens before and after the immersion tests, corrosion rate, r (IPM, inch per month), was determined by the following equation:

$$r=2.87\times10^2\ W/(A\times T\times D)$$

wherein

T=immersion time (hour)

A=surface area of the specimen ($cm^2$)

W=weight difference before and after the tests (g)

D=density of the specimen (g/$cm^2$)

Figure 4:
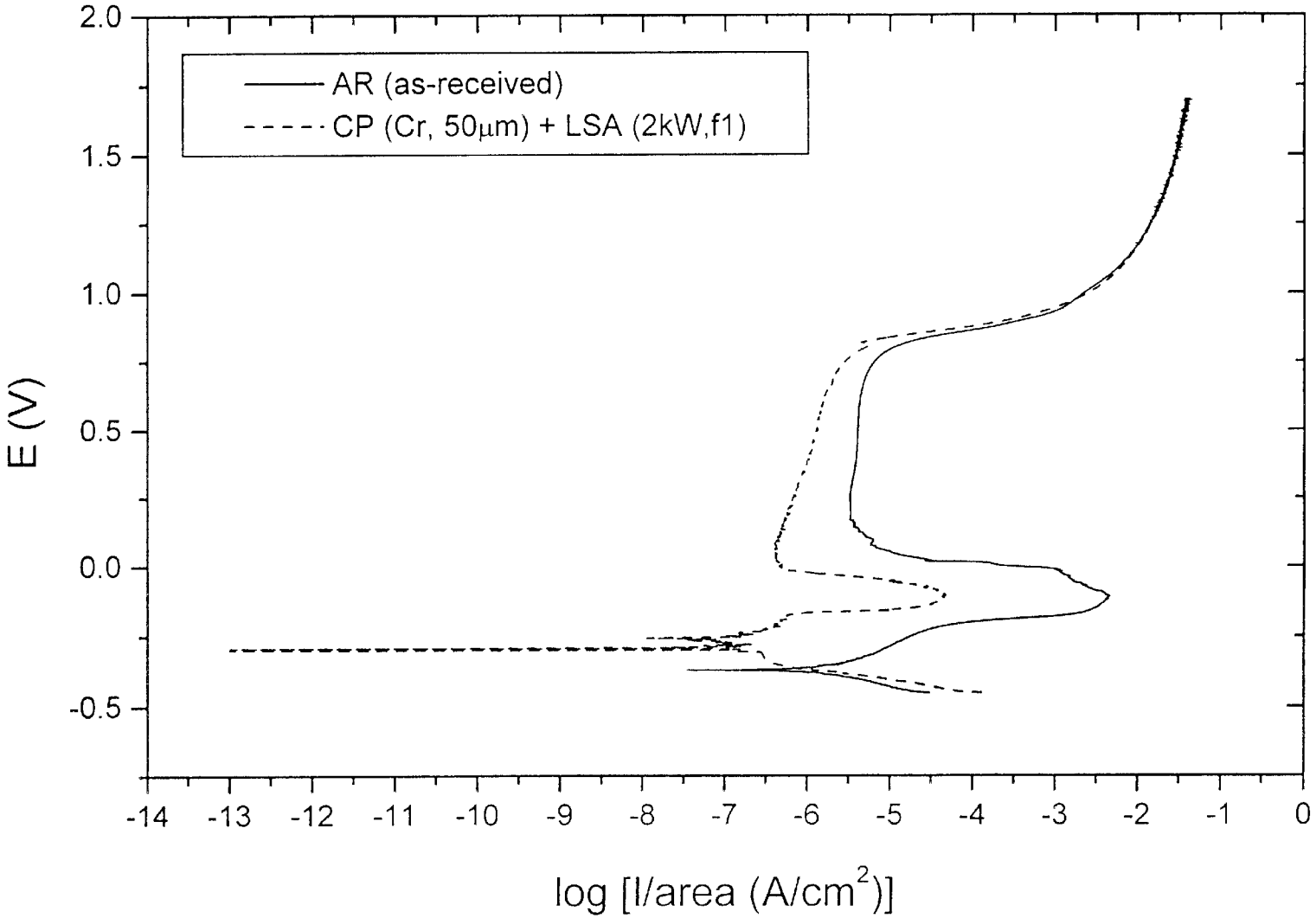
FIG. 4 represents anodic polarization curves obtained from as-received (AR) and surface-alloyed (CP) Alloy 600 in 0.01M $H_2SO_4$+0.0001M KSCN solution at 25° C. (scan rate: 0.5 mV/sec.).

According to the anodic polarization test, the surface alloyed specimen (CP in FIG. 4) showed to decrease up to more than 10 times the maximum anodic current density and the passive current density compared with these of the as-received specimens (AR in FIG. 4). This observation represents increased corrosion resistance by laser surface alloying.

Figure 5:
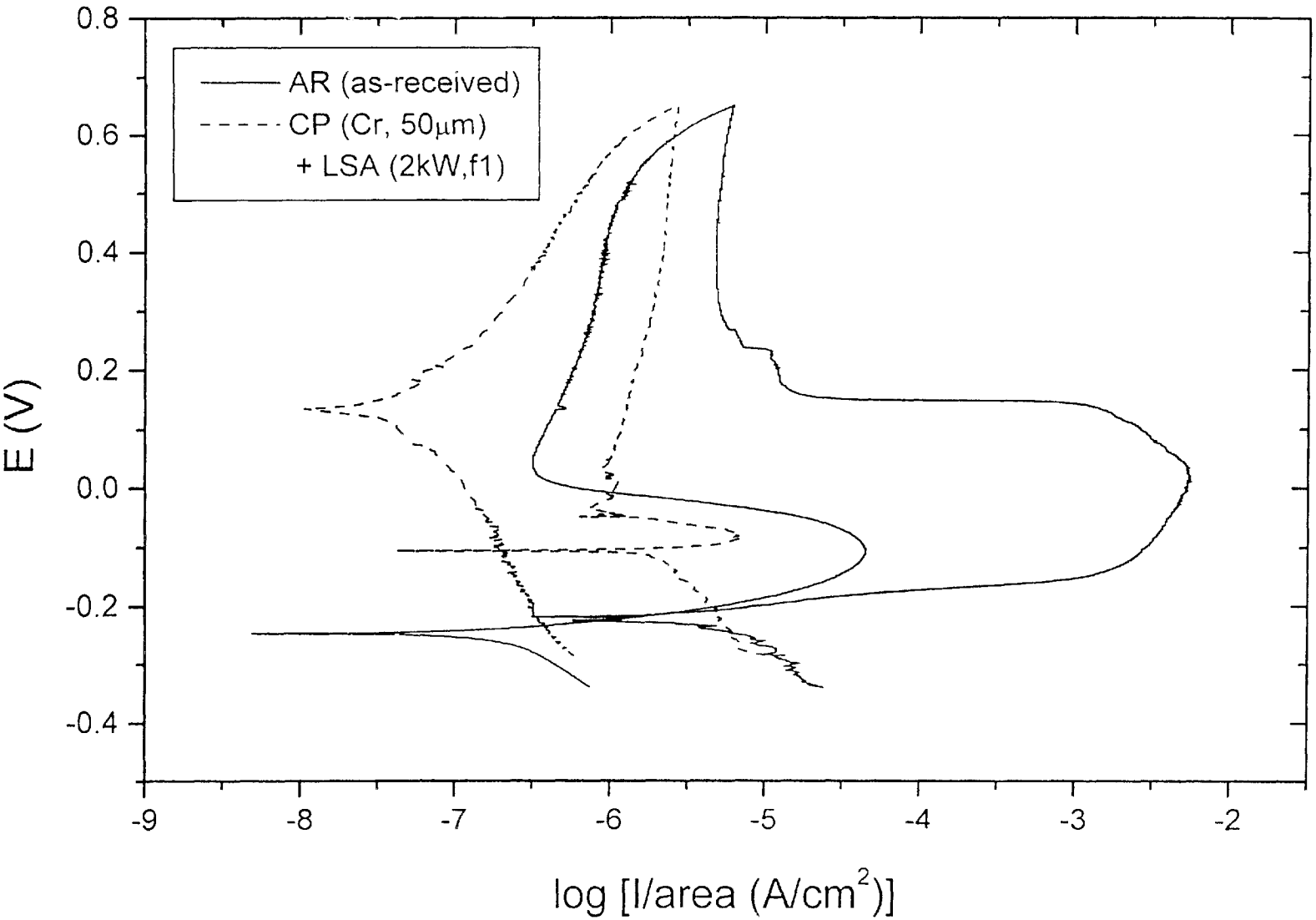
FIG. 5 represents double loop EPR curves obtained as-received (AR) and surface-alloyed (CP) Alloy 600 in 0.01M $H_2SO_4$+0.0001M KSCN solution at 25° C. (scan rate: 0.5 mV/sec.).
Figure 6:
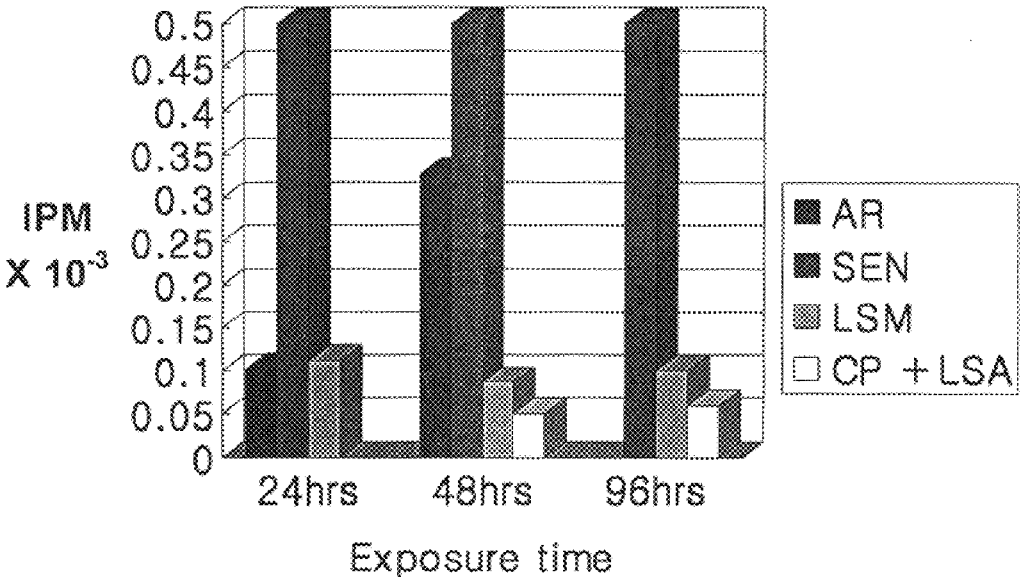
FIG. 6 represents the result of the modified Huey test obtained from as-received (AR), sensitized (SEN) laser-surface melted (LSM) and surface-alloyed (CP+LSM) Alloy 600.

The EPR test shows that Alloy 600 base material (AR curve in FIG. 5) was reactivated in reverse scanning, while the surface-alloyed specimen (CP curve in FIG. 5) was not reactivated like observed in Alloy 690. As shown in FIG. 6, the surface alloyed specimen (CP+LSM) has the lowest grain boundary corrosion resistance compared with Alloy 600 base material (AR), sensitized Alloy 600 (SEN), and laser surface melted Alloy 600 (LSM), as observed in FIG. 7 which is an optical micrograph of the surface alloyed specimen showing nearly unattacked grain boundary morphology during the modified Huey test.

EFFECT OF THE INVENTION

The present invention makes it possible to form alloyed layer having various surface properties (e.g. soft or hard surfaces, or high resistance to corrosion, abrasion, fatigue and erosion) better than these of the base material, by not changing the bulk properties of the base material.

There are many advantages in the present method: the treatment is efficient and economical since this method is conveniently carried out not only in vacuum but also in air while the prior art using electron beam should be carried out only in vacuum; and the apparatus and process of this invention can be easily automated. Moreover the process of this invention can be more simplified if surface plating method, in which alloying ingredients are added, is replaced by the improved method such as in-situ powder supply.

The processes of the present method are not limited by the working space, for example, and by the shape of an article to be treated. Also, it can be applied to the machine parts or facilities which are equipped already since the process of this invention is carried out in air.

The present method has broad application and can form the surface with versatile properties because alloy or mixture (of metal and ceramic, ceramic and ceramic), which cannot be formed in thermodynamic method, can be obtained by using a high energy density heat source, i.e. laser beam.

What is claimed is:

1. A method for surface-alloying or surface-repairing of Ni-based alloy substrate for improving the resistance against grain boundary related material degradation phenomena by increasing the concentration of Cr on surface, comprising the steps of:

(a) electroplating an alloying ingredient Cr on the surface of Ni-based alloy substrate to form a plated layer of Cr; and (b) melting this surface by using a continuous laser beam to form an alloyed layer.

2. The method of claim 1 wherein said Ni-based alloy is Alloy 600 containing:

Nickel 72.0 wt. % min.

Chromium 14.0–17.0 wt. %

Iron 6.0–10.0 wt. %

Manganese 1.0 wt. % max.

Carbon 0.15 wt. % max.

Copper 0.5 wt. % max.

Silicon 0.5 wt. % max.

Sulfur 0.015 wt. % max.

3. The method of claim 1 wherein inert gas or nitrogen gas is blown at melted zone during said melting step.

4. The method of claim 1 wherein said melting step is carried out in air.

5. A method for surface-alloying or surface-repairing of Ni-based alloy substrate for improving the resistance against grain boundary related material degradation phenomena, comprising the steps of:

(a) blowing alloying ingredients of a nonmetal in gaseous form into a melted zone on the surface of Ni-based alloy substrate; and (b) melting this surface by using a continuous laser beam to form an alloyed layer.

6. The method of claim 5 wherein the said Ni-based alloy is an alloy containing:

Nickel 72.0 wt. % min.

Chromium 14.0–17.0 wt. %

Iron 6.0–10.0 wt. %

Manganese 1.0 wt. % max.

Carbon 0.15 wt. % max.

Copper 0.5 wt. % max.

Silicon 0.5 wt. % max.

Sulfur 0.015 wt. % max.

7. The method of claim 5 wherein inert gas or nitrogen gas is blown at melted zone during said melting step.

8. The method of claim 5 wherein the said melting step is carried out in air.

* * * * *